United States Patent [19]

Hoy

[11] 4,449,265

[45] May 22, 1984

[54] SWIMMING POOL SWEEP

[76] Inventor: James S. Hoy, 7340 Filbert La., Tampa, Fla. 33617

[21] Appl. No.: 471,048

[22] Filed: Mar. 1, 1983

[51] Int. Cl.[3] ..... E04H 3/20

[52] U.S. Cl. ..... 15/1.7; 15/387

[58] Field of Search ..... 15/1.7, 387

[56] References Cited

U.S. PATENT DOCUMENTS 2,923,954 2/1960 Babcock ..... 15/1.7

3,229,315 1/1966 Watson ..... 15/1.7

FOREIGN PATENT DOCUMENTS 54-45972 4/1979 Japan ..... 15/1.7

*Primary Examiner*—Edward L. Roberts

*Attorney, Agent, or Firm*—A. W. Fisher, III

[57] ABSTRACT

A vacuum powered automatic swimming pool sweep for cleaning the bottom of a swimming pool comprising a hollow housing supported by at least one pair of reversible wheels, a reversible impeller disposed within the hollow housing, the reversible impeller including an impeller housing having an impeller chamber formed therein, a reversible impeller member having at least one pair of opposing vanes coupled thereto operatively disposed within the impeller chamber and interconnected to the pair of reversible wheels, a fluid flow conduit including a first and second fluid flow path coupled between an external vacuum line and the impeller chamber, a directional control in communication with the fluid flow conduit to selectively direct water from the pool through the impeller chamber to impinge on the movable vanes coupled to the reversible impeller member to drive the pair of reversible wheels.

6 Claims, 5 Drawing Figures

SWIMMING POOL SWEEP

BACKGROUND OF THE INVENTION

1. Field of the Invention

A vacuum powered automatic swimming pool sweep for cleaning the bottom of a swimming pool.

2. Description of the Prior Art

Typically swimming pool cleaning has been done manually. This has been accomplished by manipulating a vacuum head supported on a pole extended down into the swimming pool. Efforts have been made to automate the vacuum cleaning. One such device merely agitates the water sufficiently to place the dirt in suspension to be drawn through the pool filter. Unfortunately this does little more than disperse the dirt throughout the swimming pool water where it becomes an irritant to the swimmer. Other prior devices have included relatively complex switching arrangements to reverse the movement of the cleaning device on the pool floor requiring precise directional setting while being inoperative in pools of irregular contour.

The principal effort in cleaning a swimming pool consists of removing the sedimentary material which accumulates at the bottom of the pool. Thus, various suction-type cleaning devices have been developed. Some such devices are electricallydriven reversible cleaners. The vacuum-cleaner operates by suction and filtration of the water to clean the bottom of the pool.

German Utility Model No. 7,140,569 describes a device for vacuuming the bottom of swimming pools which comprises a double-slotted water suction nozzle and an undercarriage. The undercarriage is driven through turbine. The power required for both suction of the sediment and for propelling the device is supplied by the suction flow. The device further comprises a steering rod which is displaceable in the direction of travel and projects out beyond either the one or the other of the device. Whenever the device moves up toward a wall, the steering rod strikes the wall first and is thereby moved into its other position. This actuates the changeover gear, so that the device then travels on in opposite direction.

Other examples of prior art are disclosed in U.S. Pat. Nos. 3,979,788; 3,229,315; 3,439,368; 3,972,339; 4,100,641.

SUMMARY OF THE INVENTION

The present invention relates to a vacuum powered automatic swimming pool sweep for cleaning the bottom of a swimming pool. The swimming pool sweep comprises a hollow housing supported by a pair of reversible wheels. A reversible impeller comprises impeller housing having an impeller chamber formed therein. A reversible impeller member having several pairs of opposing vanes is operatively disposed within the impeller chamber. The reversible impeller member is operatively interconnected to the reversible sets of wheels for locomotion or movement of the swimming pool sweeper.

A fluid flow conduit comprising a first and second fluid flow path is operatively coupled between the impeller housing and an external vacuum through conduit.

A receiving chamber is formed in the lower portion of the hollow housing to receive water and debris drawn from the bottom of the pool through an inlet port comprising a slot extending substantially the width of the hollow housing.

The reversible impeller includes an inlet port in fluid communication with the receiving chamber in combination with a first, second and third outlet port. The reversible impeller member is affixed to shaft which extends through horizontally disposed slots formed on opposite sides of the hollow housing to permit lateral movement of the reversible impeller.

A directional control comprises a directional control actuator bar interconnected to a directional control flange disposed within the manifold by means of interconnecting member. The directional control further includes a bias means or spring to retain the directional control actuator bar in either the first or second position during operation of the swimming pool housing 12. Each shaft 44 includes at least one sprocket 46 to receive drive belt or chain 48 thereon. As best shown in FIGS. 1 and 4 the reversible impeller 16 includes an inlet port 50 in fluid communication with the receiving chamber 36 in combination with a first, second and third outlet port indicated as 52, 54 and 56 respectively. The reversible impeller member 22 is affixed to shaft 58 which extends through horizontally disposed slots 60 formed on opposite sides of the hollow housing 12 to permit lateral movement of the reversible impeller 16 as more fully described hereinafter. Each pair of vanes 24 comprises a first and second vane element each indicated as 62 interconnected by interconnecting vane element 64 and disposed within channels 66 to permit movement of the vane elements 24 within the slot 66 such that alternately either the first or second vane element 64 engages the inner surface of the impeller chamber 20 to control the direction of fluid flow through the reversible impeller 16 as more fully described hereinafter. Shaft 58 includes a sprocket 68 coupled to the drive belt and chain 48 such that upon rotation of the reversible impeller member 22, the pair of wheels 14 are powered to rotate in the proper direction as provided by the directional control 34 as more fully described hereinafter.

The directional control 34 comprises directional control actuator bar 68 interconnected to directional control flange 70 disposed within the manifold 71 by means of interconnecting member 72. The directional control 34 further includes a bias means or spring 74 to retain the directional control actuator bar 68 in either the first or second position during operation of the swimming pool sweep 10 as more fully described hereinafter. The manifold 71 includes a manifold outlet port 76.

During operation, the swimming pool sweep is located on the bottom of the swimming pool and interconnected to the vacuum source. As the vacuum is drawn through inlet port through the chamber and inlet port of the reversible impeller, it is drawn as shown in FIG. 4 against the vanes and through first outlet port through the first fluid flow path through manifold and then to the vacuum source. As the water is drawn through the chamber, it engages vanes rotating the impeller member in a counterclockwise direction causing wheels to move in identical direction due the drive means previously described. The flange prevents water or fluid being drawn through the second fluid flow path. It should be noted that the intermediate or third outlet port is always held slightly open to permit a continuous flow of fluid through the manifold blank during reversible operations.

Upon reaching the edge of the pool in the direction of travel, the end of actuator bar engages the side of the pool causing it to swing in the opposite direction moving the flange causing the fluid to flow through the second fluid flow path causing the impeller member to move to the right forcing the vanes to slide within the slots to permit the impeller to move in the opposite or clockwise direction. In this fashion, the sweep automatically reverses permitting the continuing operation of the swimming pool sweep.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
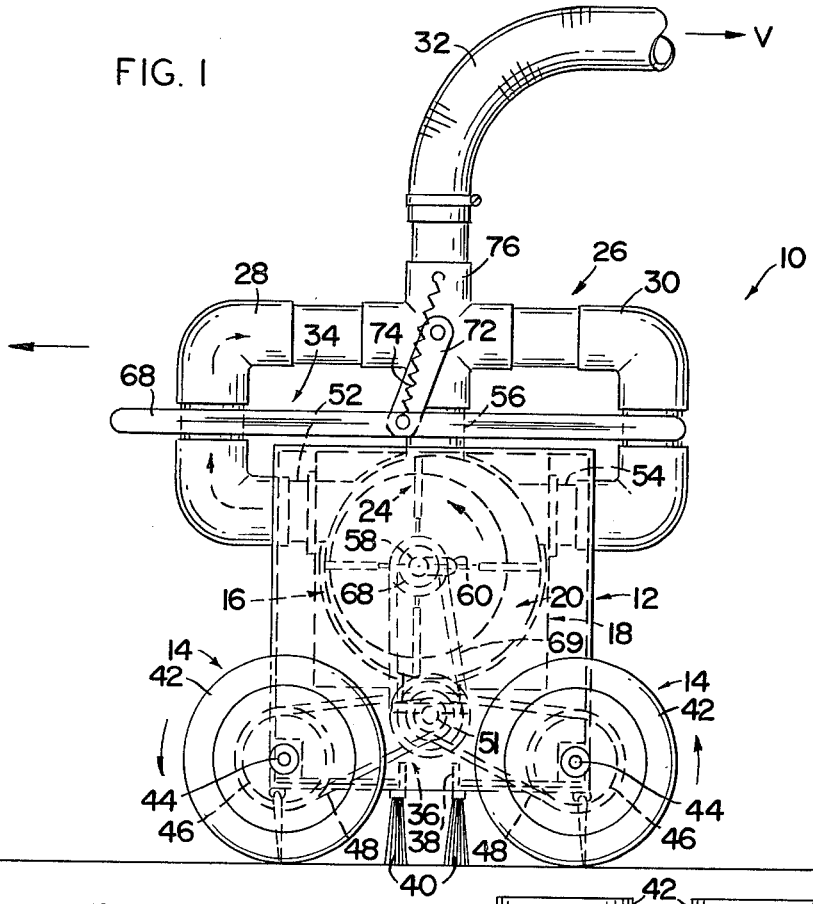
FIG. 1 is a side view of the vacuum powered automatic swimming pool sweep.
Figure 4:
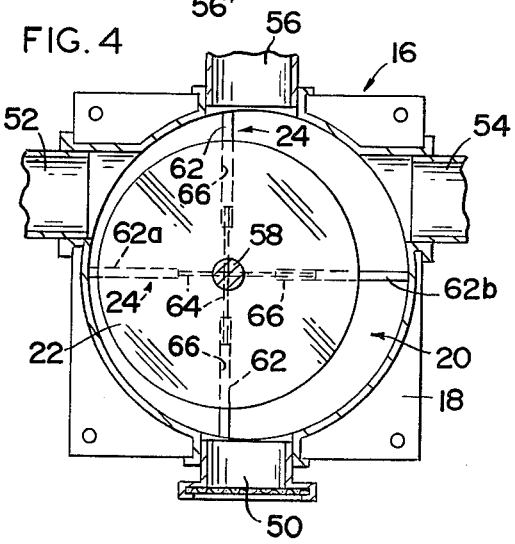
FIG. 4 is a detailed cross-sectional side view of the reversible impeller.

As best shown in FIG. 1 the present invention relates to a vacuum powered automatic swimming pool sweep generally indicated as 10 for cleaning the bottom of a swimming pool. The swimming pool sweep 10 comprises a hollow housing 12 supported by a pair of reversible wheels each indicated as 14. A reversible impeller generally indicated as 16 as best shown in FIG. 4, comprises impeller housing 18 having an impeller chamber 20 formed therein. A reversible impeller member 22 having several pairs of opposing vanes generally indicated as 24 is operatively disposed within the impeller chamber 20. As described more fully hereinafter the reversible impeller member 20 is operatively interconnected to the reversible sets of wheels 14 for locomotion or movement of the swimming pool sweeper 10.

A fluid flow conduit generally indicated as 26 comprising a first and second fluid flow path 28 and 30 respectively is operatively coupled between the impeller housing 18 and an external vacuum (not shown) through conduit 32. A directional control is generally indicated as 34.

A receiving chamber 36 is formed in the lower portion of the hollow housing 12 to receive water and debris drawn from the bottom of the pool through inlet port 38. Inlet port 38 may comprise a slot extending substantially the width of the hollow housing 12. Disposed on opposite sides of the inlet port 38 is a pair of bristles or brushes each indicated as 40.

Figure 2:
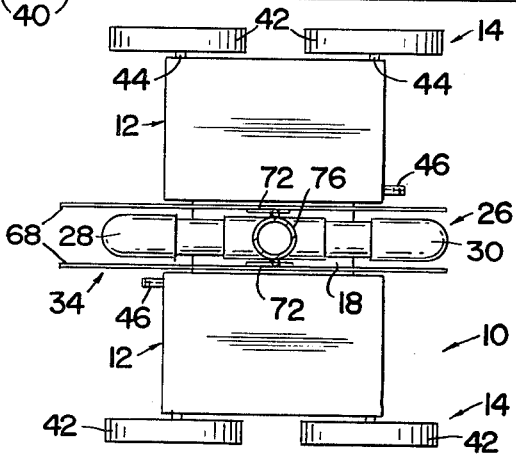
FIG. 2 is a top view of the vacuum powered automatic swimming pool sweep.
Figure 5:
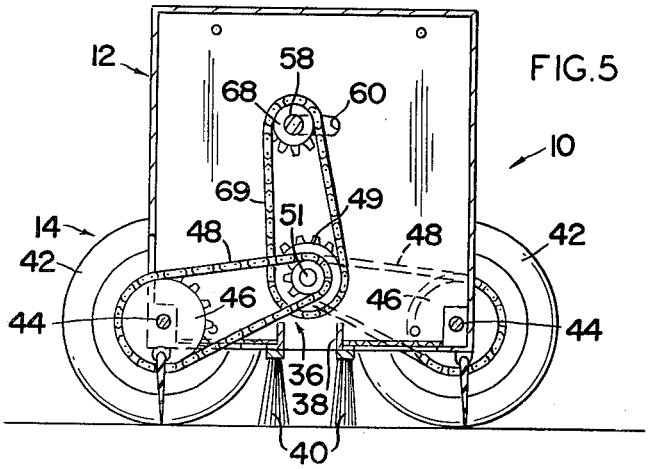
FIG. 5 is a detailed cross-sectional side view of the hollow housing.

As best shown in FIGS. 1, 2, and 5, each pair of reversible wheels 14 comprises a wheel 42 interconnected at opposite ends of rotatable shaft 44 disposed on opposite sides of the hollow housing 12. Each shaft 44 includes at least one sprocket 46 to receive drive belt or chain 48 thereon coupled to sprocket 49 on axle 51. As best shown in FIGS. 1 and 4, the reversible impeller 16 includes an inlet port 50 in fluid communication with the receiving chamber 36 in combination with a first, second and third outlet port indicated as 52, 54 and 56 respectively. The reversible impeller member 22 is affixed to shaft 58 which extends through horizontally disposed slots 60 formed on opposite sides of the hollow housing 12 to permit lateral movement of the reversible impeller 16 as more fully described hereinafter. Each pair of vanes 24 comprises a first and second vane element each indicated as 62 interconnected by interconnecting vane element 64 and disposed within channels 66 to permit movement of the vane elements 24 within the slot 66 such that alternately either the first or second vane element 64 engages the inner surface of the impeller chamber 20 to control the direction of fluid flow through the reversible impeller 16 as more fully described hereinafter. Shaft 58 includes a sprocket 68 coupled to sprocket 49 by a drive belt and chain 69 such that upon rotation of the reversible impeller member 22, the pair of wheels 14 are powered to rotate in the proper direction as provided by the directional control 34 as more fully described hereinafter.

The directional control 34 comprises directional control actuator bar 68 interconnected to directional control flange 70 disposed within the manifold 71 by means of interconnecting member 72. The directional control 34 further includes a bias means or spring 74 to retain the directional control actuator bar 68 in either the first or second position during operation of the swimming pool sweep 10 as more fully described hereinafter. The manifold 71 includes a manifold outlet port 76.

During operation, the swimming pool sweep 10 is located on the bottom of the swimming pool (not shown) and interconnected to the vacuum source (not shown) through conduit 32. As the vacuum is drawn through inlet port 38 through the chamber 36 and inlet port 50 of the reversible impeller 16, it is drawn as shown in FIG. 4 against the vanes 62*b* and through first outlet port 52 through the first fluid flow path 24 through manifold 71 and then to the vacuum source. As the water is drawn through the chamber 20 it engages vane 62*b* rotating the impeller member 22 in a counterclockwise direction causing wheels to move in identical direction due the drive means previously described. The flange 70 prevents water or fluid being drawn through the second fluid flow path 30. It should be noted that the intermediate or third outlet port 56 is always held slightly open to permit a continuous flow of fluid through the manifold blank during reversible operations.

Figure 3:
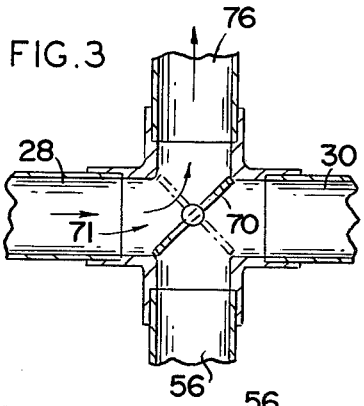
FIG. 3 is a cross-sectional detailed view of a portion of the directional control.

Upon reaching the edge of the pool in the direction of travel, the end of actuator bar 68 engages the side of the pool causing it to swing in the opposite direction moving the flange 70 from the position shown in FIG. 3 in solid, to the position shown in FIG. 3 in the phantom lines causing the fluid to flow through the second fluid flow path 30 causing the impeller member 22 to move to the right forcing the vanes 24 to slide within the slots 66 to permit the impeller 16 to move in the opposite or clockwise direction. In this fashion the sweep automatically reverses permitting the continuing operation of the swimming pool sweep 10.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all the generic and specific features of the invention herein described, and all statements of the scope of the invention which as a matter of language, might be said to fall therebetween.

Now that the invention has been described,

What is claimed is:

1. A vacuum powered automatic swimming pool sweep for cleaning the bottom of a swimming pool comprising a hollow housing supported by at least one pair of reversible wheels, a reversible impeller disposed within said hollow housing, said reversible impeller including an impeller housing having an impeller chamber formed therein, a reversible impeller member having at least one pair of opposing vanes coupled thereto operatively disposed within the impeller chamber and interconnected to said pair of reversible wheels, a fluid flow conduit including a first and second fluid flow path coupled between an external vacuum line and said impeller chamber, a directional control movable between a first and second position in communication with said fluid flow conduit to selectively direct water from the pool through said impeller chamber to impinge on said vanes coupled to said reversible impeller member to drive the pair of reversible wheels, said directional control causing water to flow through said first fluid flow path when in said first position to drive said swimming pool sweep in one direction and causing water to flow through said second fluid flow path when in said second position to drive said swimming pool sweep in the opposite direction.

2. The swimming pool sweep of claim 1 wherein said pair of opposing vanes are movably disposed within a slot formed in said reversible impeller member, said reversible impeller member movable to one side or the other of said impeller chamber to direct the flow of water through said impeller chamber.

3. The swimming pool sweep of claim 2 wherein said impeller housing includes a first outlet port in fluid communication with said first fluid flow path and a second outlet port in fluid communication with second fluid flow path, said fluid flow conduit further including a manifold coupled between said first and second fluid flow path, said directional control including a directional control valve movable between a first and second position within said manifold to selectively direct fluid to said manifold outlet port from said first or second fluid flow path.

4. The swimming pool sweep of claim 3 wherein said directional control further includes a directional control actuator bar coupled to said directional control flange to selectively engage the side of the pool to move said directional control actuator bar and said directional control flange from said first to said second position.

5. The swimming pool sweep of claim 4 wherein said impeller housing includes a third outlet port disposed adjacent said directional control flange to continuously feed water from said impeller chamber during operation of said swimming pool sweep.

6. The swimming pool sweep of claim 1 wherein said reversible impeller member is coupled to said of reversible wheels by interconnecting means such that said direction of rotation of said pair of reversible wheels is controlled by the direction of rotation of said reversible impeller member.

* * * * *